166-139 SR

10/22/85 OR 4,548,264

United States Patent [19]

Manderscheid

[11] Patent Number: 4,548,264

[45] Date of Patent: Oct. 22, 1985

[54] HIGH TEMPERATURE WELL PACKER

[75] Inventor: Phillip H. Manderscheid, Cypress, Tex.

[73] Assignee: Hughes Tool Company, Houston, Tex.

[21] Appl. No.: 598,653

[22] Filed: Apr. 10, 1984

[51] Int. Cl.[4] ..... E21B 33/128; E21B 33/129

[52] U.S. Cl. ..... 166/139; 166/216

[58] Field of Search ..... 166/138, 139, 216, 217

[56] References Cited

U.S. PATENT DOCUMENTS

| | | | |
|---|---|---|---|
| 2,825,410 | 3/1958 | Brown | 166/139 |
| 3,342,268 | 9/1967 | Brown | 166/124 |
| 3,507,327 | 4/1970 | Chenoweth | 166/139 X |
| 3,643,737 | 2/1972 | Current et al. | 166/216 |
| 3,889,750 | 6/1975 | Mullins | 166/217 |
| 4,336,841 | 6/1982 | Garner, Jr. | 166/246 |
| 4,375,240 | 3/1983 | Baugh et al. | 166/387 |
| 4,427,063 | 1/1984 | Skinner | 166/139 X |

*Primary Examiner*—Stephen J. Novosad
*Assistant Examiner*—William P. Neuder
*Attorney, Agent, or Firm*—Robert A. Felsman; Charles D. Gunter, Jr.

[57] ABSTRACT

A well packer is shown which is particularly suitable for use in high temperature well environments, such as in fire flooding and steam injection secondary recovery techniques. The well packer has a central mandrel which extends within an outer assembly, including a top body with an interior bore, which circumscribes the central mandrel. The central mandrel has an external flange region about a portion of the circumference, for contacting abutment members within the top body bore when the mandrel is rotated within the body, to transmit torque to the outer assembly. A seal element in the outer assembly moves radially outwardly between a retracted and extended configuration to sealingly engage the well bore. A slip-cone assembly carried in the outer assembly moves between retracted and extended positions to grip the well bore and anchor the tool. A sliding dog and cooperating setting nut mechanism transmit torque responsive to rotation of the central mandrel, to propel the cones beneath the gripping slips to anchor the assembly to the well bore with the seal in the extended configuration. A knock-down collet carried on the lower cone, cooperates with a release sub at the lower end of the central mandrel to facilitate release of the gripping slips during retrieval operations.

3 Claims, 10 Drawing Figures

HIGH TEMPERATURE WELL PACKER

BACKGROUND OF THE INVENTION

1. Field of the Invention:

This invention relates to devices and techniques for sealing cylindrical members to circumscribing conduits. More specifically, the present invention relates to a well packer for sealing a pipe string to a surrounding well conduit, such as is provided by the casing or a well liner, and is suitable for use in high temperature applications.

2. Description of the Prior Art:

Well packers and other downhole equipment are often exposed to high temperatures. In particular, certain secondary recovery techniques for producing hydrocarbons include thermal recovery operations. Such operations include fire flooding and steam injection. In a fire flooding operation, oil said about the periphery of a high viscosity oil formation is ignited and the fire is maintained by the injection of air through wells about the formation horizon. As the combustion front advances through the formation, the oil decreases in viscosity and increases in mobility, moving toward one or more producing wells communicating with the interior of the formation.

Steam injection techniques include the injection of steam into wells to reduce the viscosity of the formation oil, so that the oil can be removed by a producing well. Alternately, the steam can be circulated down a well through which the reduced viscosity oil is produced, with the oil being isolated from the steam within the well bore.

Where thermal operations of the above types are being carried out, downhole equipment is subjected to unusual stresses caused by variations in the length of the equipment, particularly the tubing string, due to the wide ranging temperature changes which must be accomodated. U.S. Pat. No. 3,391,742 discloses a mechanically set, retrievable well packer, adapted for use in high temperature well operations. After the packer is set, the tubing string used in running the packer into position can be moved longitudinally, relative to the outer packer assembly, which is sealed and anchored to the surrounding well conduit, without unseating the packer. A dual mandrel assembly provides the capability of circulating steam while producing hydrocarbons through the packer.

U.S. Pat. No. 4,375,240 shows a hydraulically set, retrievable well packer, adapted for thermal recovery operations. The sealing members utilized in the packer are constructed of a material which permits the mandrel to remain sealed to the well conduit in the presence of high temperatures. The packer can be released by straight longitudinal movement of the mandrel, relative to the outer packer assembly.

Even though the above packer designs perform satisfactorily in thermal recovery operations, there exists a need for a thermal packer of simplified design and lower overall manufacturing costs. There exists a need for such a packer with fewer moving parts and simpler operation for improved reliability. There exists a need for such a tool which can be set by immediate rotation of the running string without the need for longitudinal movement to unjay a latch mechanism. There also exists a need for such a tool with an improved release mechanism to facilitate retrieving the device from the well bore.

These and other objects are accomplished as described in the specification which follows.

SUMMARY OF THE INVENTION

The well packer of the invention is adapted to be releasably set internally in a well bore. The packer has a central mandrel which extends within an outer assembly. The outer assembly includes a top body with an interior bore of a greater diameter than, and circumscribing the central mandrel. The central mandrel has an external flange region about a portion of the circumference thereof. The flange region operates to contact abutment means within the top body bore when the mandrel is rotated within the body, whereby torque is transmitted to the outer assembly.

Seal means, as a part of the outer assembly, are moved radially outwardly between a retracted configuration and an extended configuration in which the seal means sealingly engage the well bore. Anchoring means, as a part of the outer assembly, move between a retracted position and an extended gripping position in which the anchoring means grippingly engage the well bore. Setting means, as a part of the outer assembly, are responsive to rotation of the central mandrel, whereby at least a portion of the setting means are propelled axially to move the seal means to the extended configuration and to move the anchoring means to the extended position.

The central mandrel is slidable axially within the top body bore between a retracted, torque-transmitting position for actuating the setting means, and an extended position to compensate for size variations in the tubing string.

A split collet assembly is carried about the lower end of the outer assembly and cooperates with a release sub located on the lower end of the central mandrel. Downward longitudinal movement of the mandrel causes the release sub to act upon the setting means to facilitate removal of the packer from the well bore.

Additional objects, features, and advantages will be apparent in the written description which follows.

DETAILED DESCRIPTION OF THE INVENTION

Figure 1A:
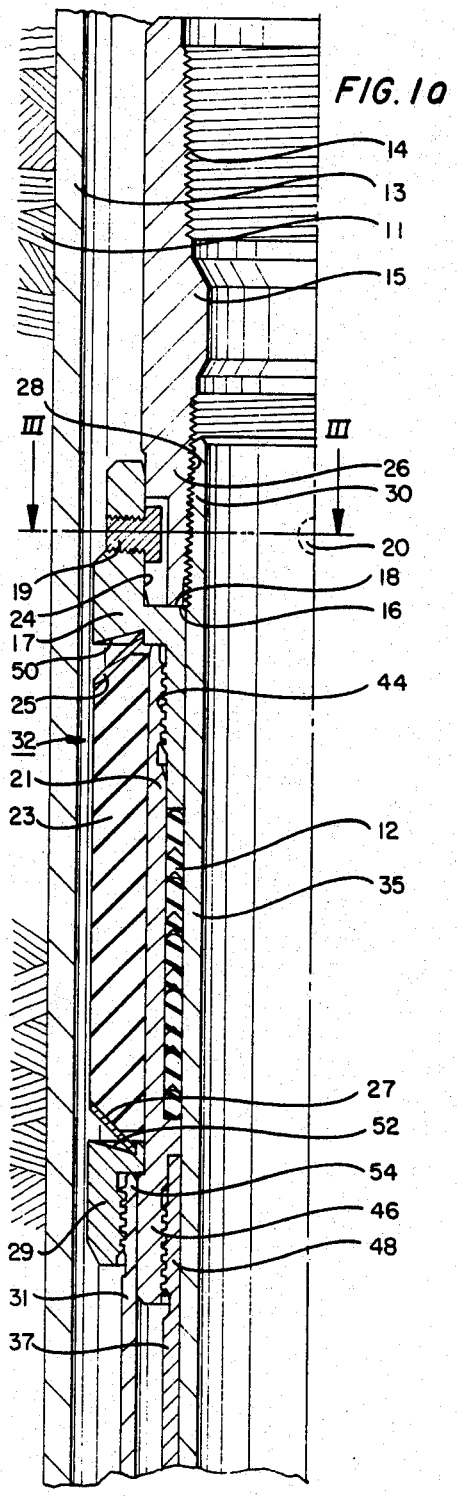
FIG. 1*a* is a side, cross-sectional view of the upper end of a well packer of the invention, in the running-in position.

FIG. 1*a* shows a well packer of the invention being run into position within a well bore 11 lined by a casing 13. The well packer includes a tubular top connection 15 having an internally threaded end 14 adapted to be made up in a running string (not shown) extending to the well surface. Top connection 15 has a lower shoulder 16, which is received upon a ledge 18 within the interior bore 24 of a top body 17 which circumscribes the lower extent 26 of the top connection 15 in the position shown.

Figure 3:
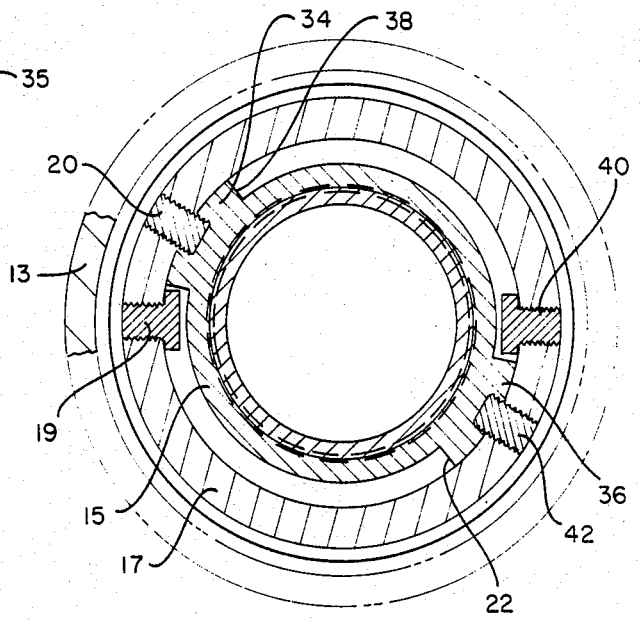
FIG. 3 is a cross-sectional view taken along lines III—III in FIG. 1*a*.
Figure 2A:
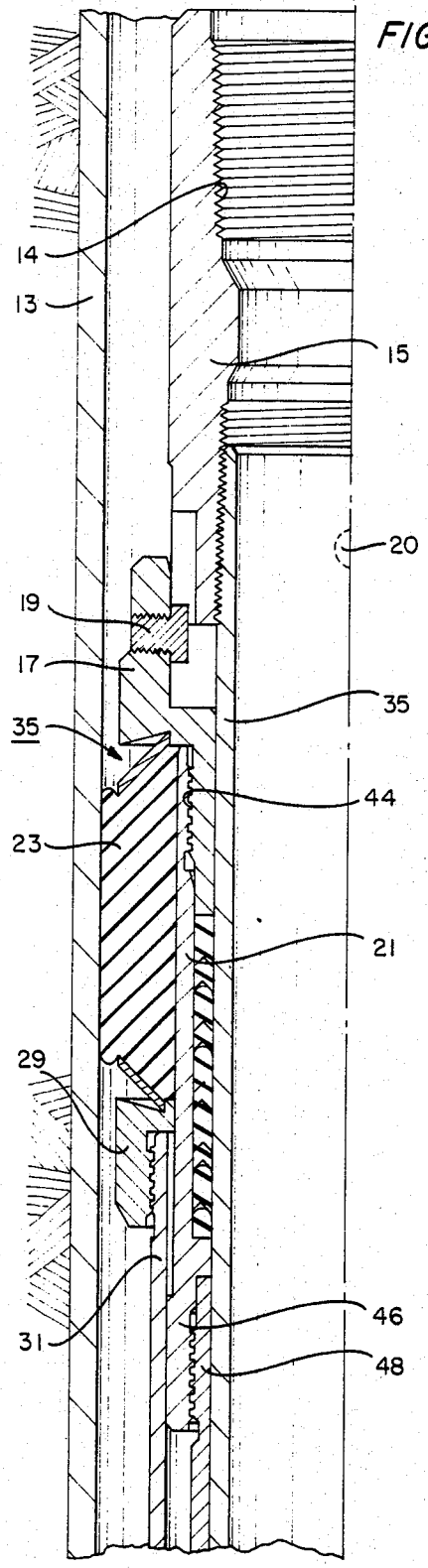
FIG. 2*a* is a side, cross-sectional view of the upper end of the well packer of the invention, similar to FIG. 1*a*, but in the set position in the well bore.
Figure 2B:
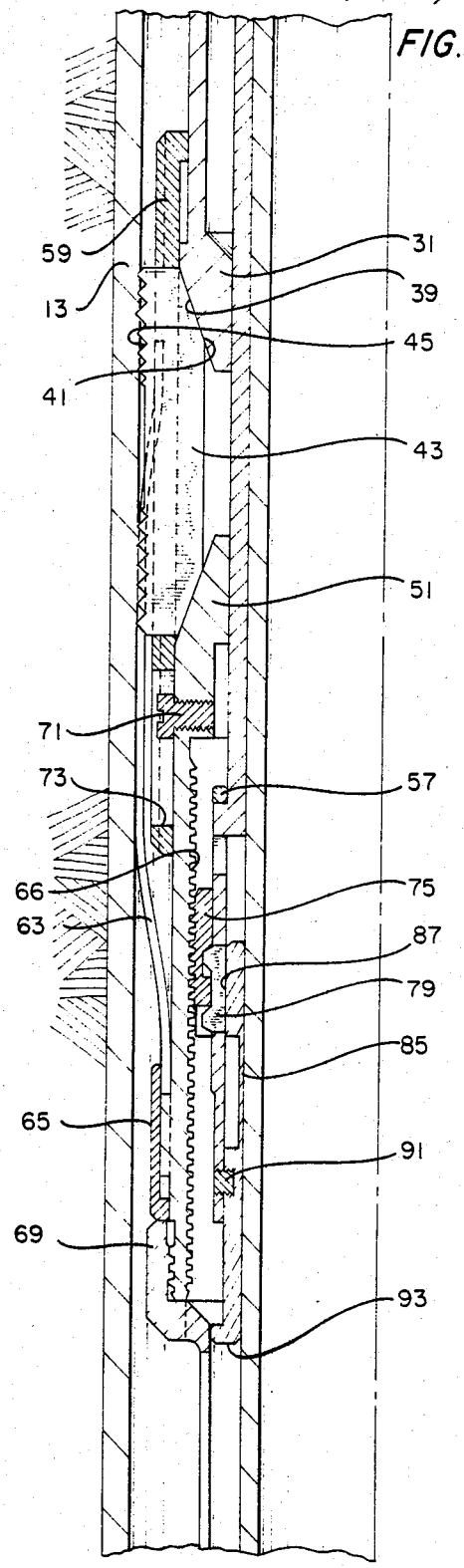
FIG. 2*b* is a downward continuation of FIG. 2*a*, showing the anchoring means in the set position.
Figure 2C:
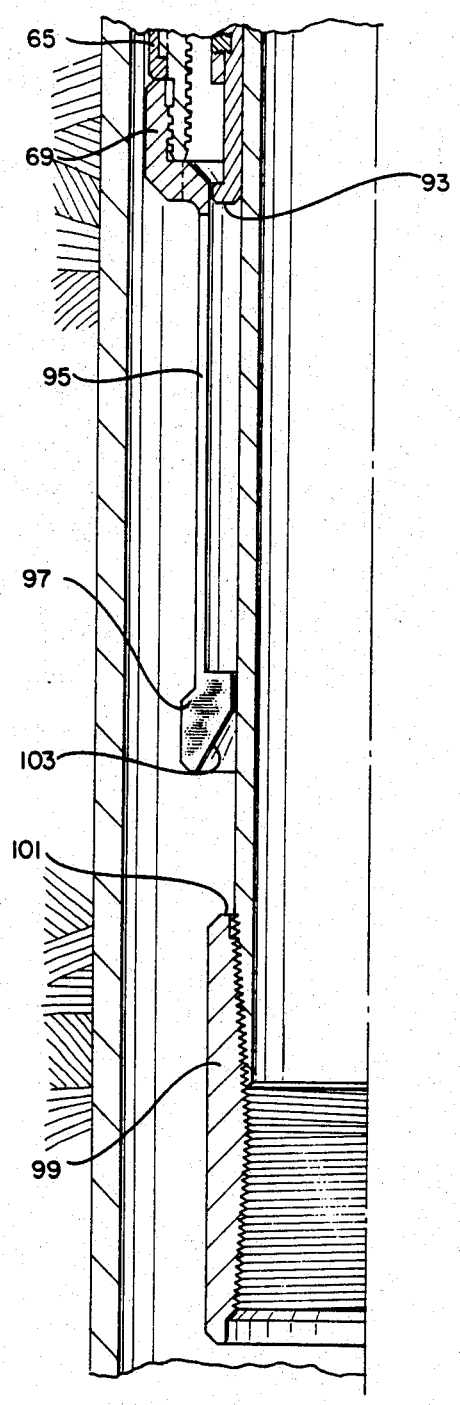
FIG. 2*c* is a downward continuation of FIG. 2*b*, showing the lower end of the well packer.

As shown more clearly in FIG. 3, the top connection 15 is initially connected by shear means, such as shear pins 20, 42 to the top body 17. An internally threaded region 28 (FIG. 1*a*) of the top connection 15 matingly engages the upper extent 30 of a central mandrel 35 which extends downwardly within an outer assembly, designated generally as 32 in FIG. 1*a*. As shown in FIG. 3, the top connection 15 has a pair of oppositely positioned external flange regions 34, 36, each of which has a shoulder 22, 38, for contacting abutment means, such as screws, 19, 40 carried within bore 24. As shown in FIG. 3, rotation of the top connection 15 with sufficient torque to shear pins 20, 42, allows shoulders 22, 38 to contact screws 19, 40, whereby torque applied to the running string is transmitted to the top body 17. Once pins 20, 42 are sheared, central mandrel 35 is axially slidable within outer assembly 32, as will be later described in greater detail.

The top body 17 (FIG. 1*a*) has an externally threaded region 44 for matingly engaging a cylindrically-shaped seal mandrel 21. Seal mandrel 21, in turn, has a lower connecting end 46 which is suitably threaded to matingly engage the connecting end 48 of a connecting tube 37, which circumscribes the exterior of central mandrel 35. A plurality of annular, secondary seal members 12 provide a fluid-tight seal between the exterior of the central mandrel 35 and the remainder of the outer assembly 32. The mandrel seal members 12 can be formed of asbestos packing, or other packing particularly suitable for use in high temperature environments. A primary seal 23 surrounds the seal mandrel 21 and is carried between a retainer ring 29 at one end and top body 17 at the opposite end. The primary seal 21 can be of a suitable high temperature elastomer or can be fashioned with asbestos packing, suitable for use in high temperature environments. Axial compression of the primary seal 23 induces radial expansion of the seal to insure a fluid-tight, sealing engagement with the well casing 13. The primary seal 23 (shown) is located between a pair of Bellville washers 25, 27, which are received upon cooperating ledges 50, 52 of the respective top body 17 and retaining ring 29.

Figure 1B:
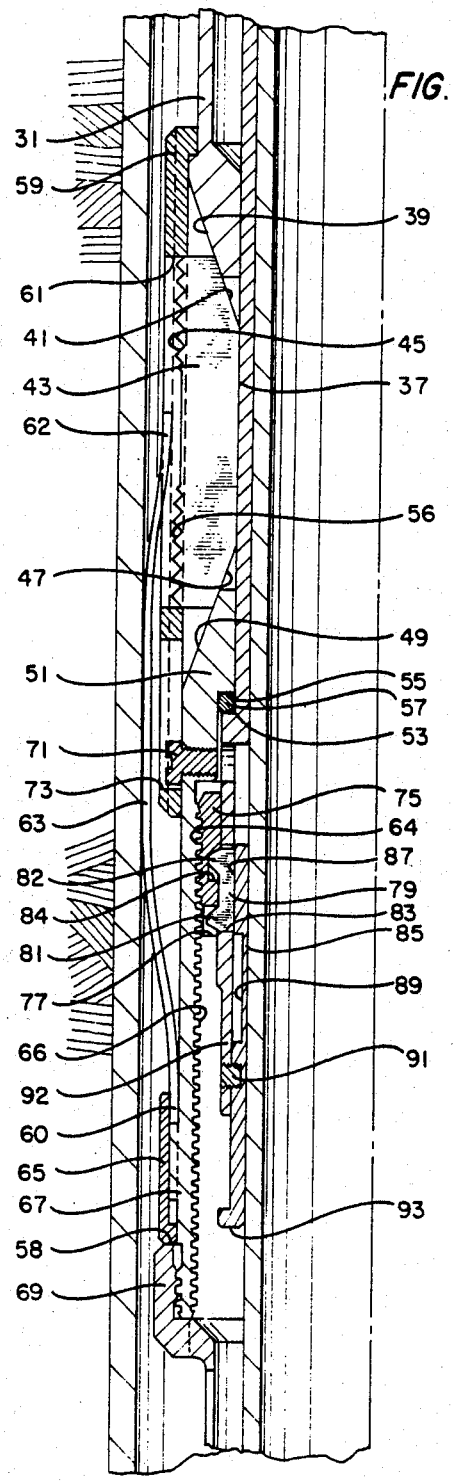
FIG. 1*b* is a downward continuation of FIG. 1*a*, showing the anchoring means thereof.

Retainer ring 29 is internally threaded to matingly engage the upper end 54 of tubular upper cone 31 which comprises a part of the anchoring means of the well packer. As shown in FIG. 1*b*, the upper cone 31 includes a downwardly extending, frustoconical wedging surface 39, that is generally complementary to a downwardly facing, slanted lower cam surface 41 of a slip member 43. The anchoring means of the invention also includes a generally tubular slip cage 59, with three sets of paired windows 61. Three slip members, such as member 43, are mounted on the slip cage 59, for radial movement relative thereto. Each of the slip members 43 features upper and lower gripping surfaces 45, 56, positioned to extend radially through corresponding windows 61. Each slip member 43 is normally biased radially inwardly by a coil spring (not shown) residing in a recess in each of the slip members within the cage 59. This arrangement serves to maintain the gripping surfaces 45, 56, retracted in the absence of forces propelling the slip members radially outwardly.

A lower cooperating surface 47 of each slip member 43 contacts an upwardly facing frustoconical surface 49 of a lower tubular spreader cone 51. Lower cone 51 includes an inner shoulder 55, which engages an a bearing ring 57 between shoulder 55 and a ledge 53, provided in the connecting tube 37, in the position shown. Three pins 71 extend radially outwardly from the lower cone assembly 51 and reside in elongated, axially oriented slots 73 in the slip cage 59, to allow cage 50 to pick up lower cone 51 during release, as will be described. As shown in FIG. 1*b*, the lower end 67 of the lower cone 51 threadedly engages the upper end 69 of a knock-down collet. A spring-retaining ring 65 is located upon the lip 58 of the collet end 69 and retains one end 60 of one of a plurality of bow springs 63. The opposite ends 62 of the springs 63 are received in a recess provided in the upper end of the cage assembly 59.

A setting nut 75 has an outer threaded surface 64 which engages the threaded interior 66 of the lower tubular cone end 67 for travel along the threaded surface 66. Torque is transmitted to the setting nut 75 through a sliding dog 79 received within a window 83 provided in the connecting tube 37. Dog 79 has protrusions 81, 82 which are received within an undercut area 77, and within a groove 84, respectively, of the setting nut 75. A support sleeve 85 is carried about the central mandrel 35 and is connected by means of one or more shear pins 91, to the lowermost extent 92 of the connecting tube 37. The support sleeve 85 has a region of increased external diameter 87 which underlies the interior of the sliding dog 79 in the position shown. The support sleeve 85 also has a region of decreased external diameter 89, and a lower exposed end 93.

Figure 1C:
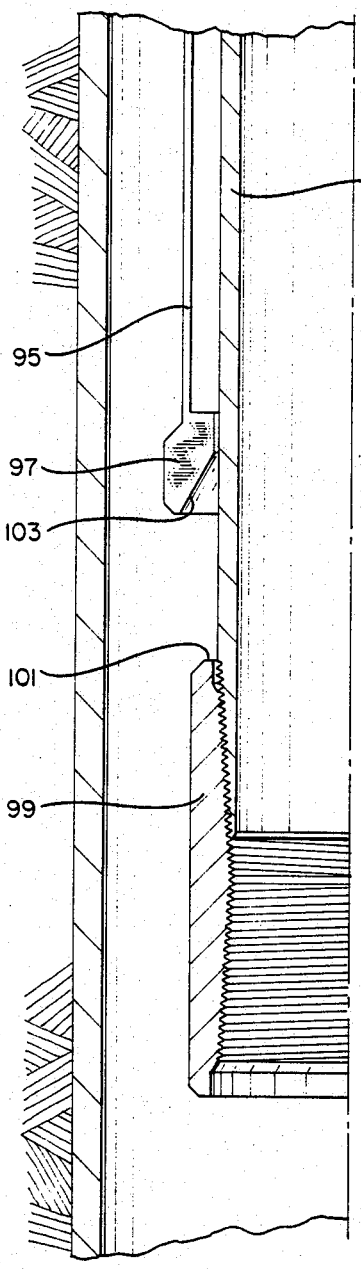
FIG. 1*c* is a downward continuation of FIG. 1*b*, showing the lower end of the well packer of the invention.
Figure 4A:
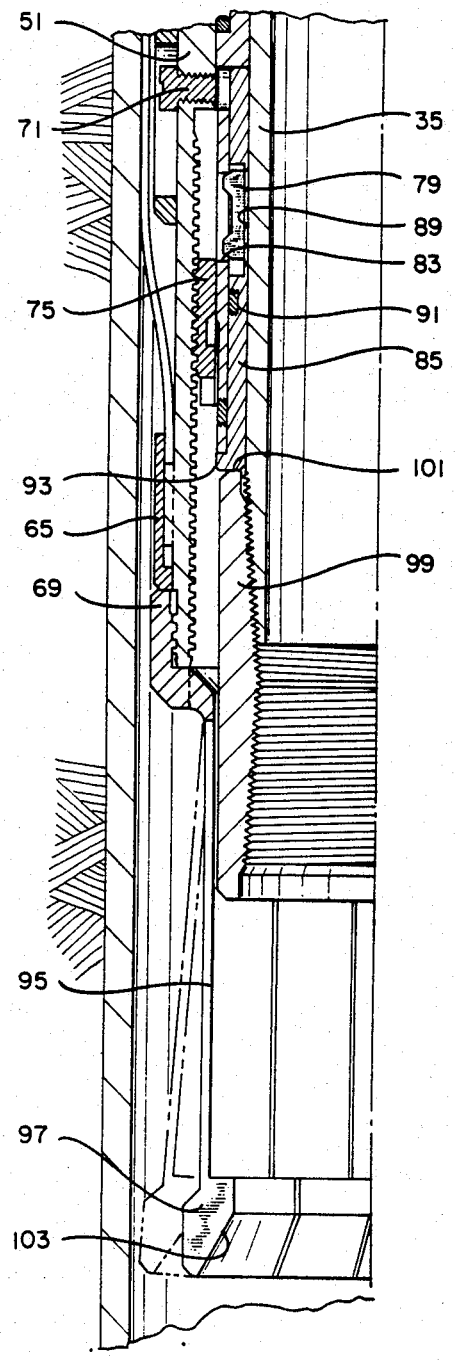
FIG. 4*a* is a side, cross-sectional view of the lower end of the well packer, showing the operation of the release sub and split collet of the packer.
Figure 4B:
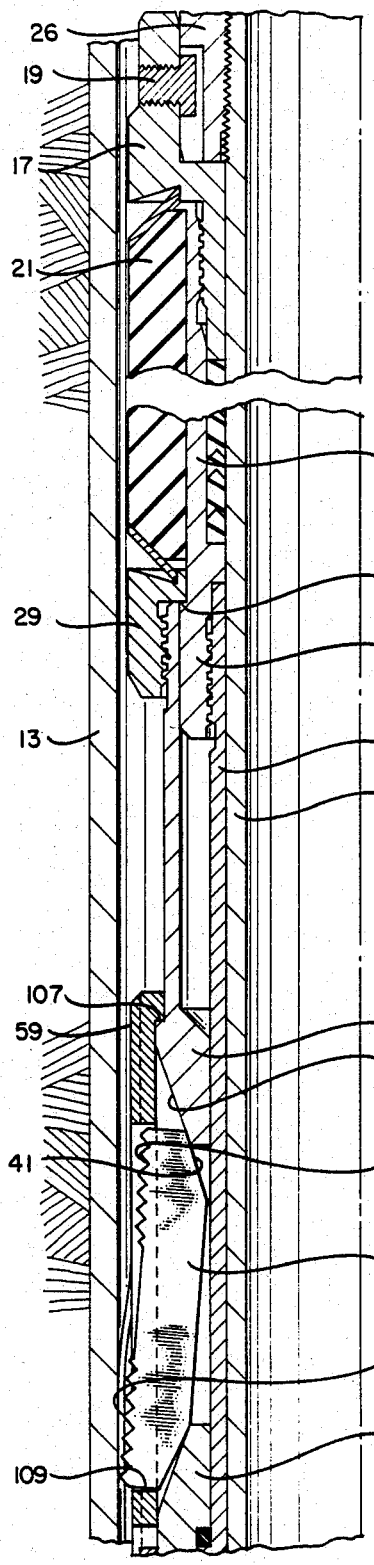
FIG. 4*b* is an upward continuation of FIG. 4*a*, showing the continuation of the release operation of the packer.
Figure 5:
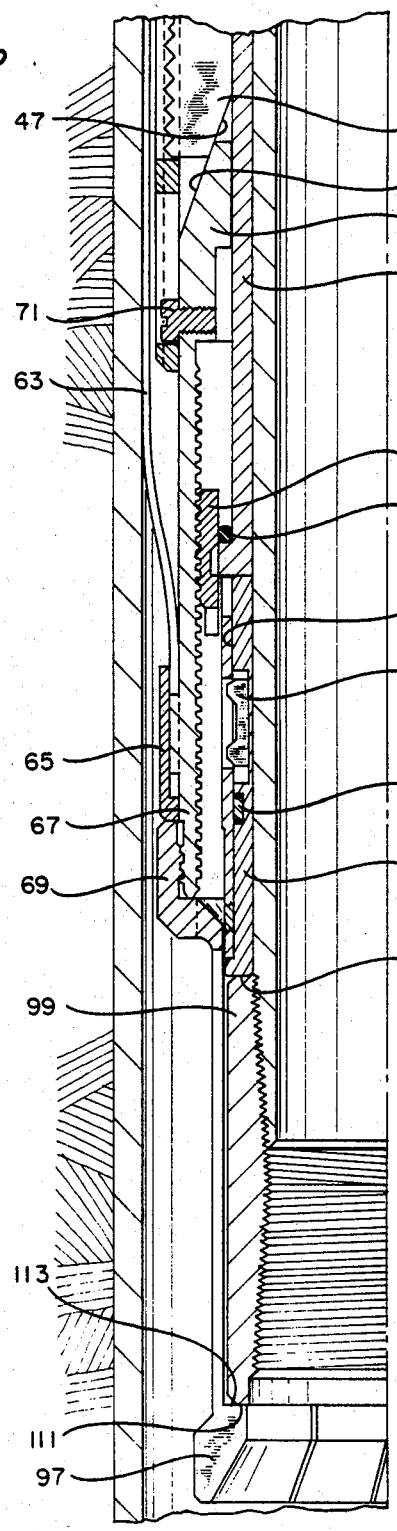
FIG. 5 is a view similar to FIG. 4*a*, showing the final step in the release operation of the packer.

As shown in FIG. 1*c*, the knock-down collet upper end 69 continues downwardly to form a split collet body 95, with terminating ends 97. Each terminating end 97 includes an interior slanting region 103, which is aligned for contact with the upper shoulder 101 of a release sub 99, carried about the lower end of the central mandrel 35. The split collet body 95 allows upward sliding movement of the mandrel release sub 99 through the collet as shown in FIGS. 4*a* and 5.

The operation of the well packer of the invention will now be described. The well packer would first be lowered to the desired depth within the well bore, in the configuration shown in FIGS. 1*a*–1*c*. As the packer is lowered into position, the bow springs 63 frictionally engage the casing 13 as shown in FIG. 1*b*. Pins 20, 42 secure the top connection, and hence the central mandrel 35, to the top body and outer assembly during the running-in operation. Once the desired depth is reached, the running string is rotated from the surface, usually clockwise. As shown in FIG. 3, sufficient rotational torque, e.g., 2100 foot pounds, causes the shear pins 20, 42 to sever, allowing the flange regions 34, 36 to rotate, so that the shoulders 22, 38 contact the respective abutment means 19, 40. The torque transmitting features of the well packer allow the initial setting force to be applied through the running string immediately upon reaching the desired depth by simply turning the running string to the right. Since no J-mechanism is utilized, it is not necessary to apply axial forces to the running string.

Right-hand rotation of the running string acts through the top connection 15 and abutment means 19, 40, upon the connecting tube 37, and hence upon the sliding dog 79, carried within the window 83 of the connecting tube. Torque is similarly transmitted through the sliding dog 79, through the protrusion 81 to the undercut area 77 of the setting nut 75, causing the setting nut to move downwardly with respect to the lower cone 51. The bow springs 63 frictionally engage the well casing 13 so that rotation of the springs 63, cage 59 and lower cone 51 is prevented.

The resulting action propels the lower slip 51 upwardly within the cage 59, causing the frustoconical surface 49 to contact the cooperating slip surface 47. The upward force is transmitted through the slip member 43 through surfaces 39, 41, and through the upper cone 31 in the direction of the primary seal 23. As the running string continues to be rotated from the surface, setting nut 75 continues to travel down the threaded interior 66 of the lower cone, eventually resulting in the gripping surface 56 of the slip 43, contacting and grippingly engaging the surrounding well casing 13.

Once the gripping slip 43 has engaged the well casing 13, upward movement of the lower cone 51 is prevented. Continued travel of the setting nut 75, with respect to the lower cone 51, results in a compressive force being transmitted through the top body 17 to the primary seal 23, in the direction of the retainer ring 29. Continued rotation of the running string causes the seal to be further compressed and make sealing contact with the surrounding casing 13.

The well packer of the invention would now be in the set condition, as shown in FIGS. *2a–2c*. It will be noted that the setting nut 75 has traveled part way down the threaded interior 66 of the lower cone 51, and the lower cone 51 has forced the slip member 43 radially outwardly to engage the well casing 13. Surface 39 of upper cone 31 has been driven beneath the cooperating inclined surface 41 of the slip member 43 to engage the upper gripping surface 45 of the slip member with the casing. The region of increased diameter 87 of the support sleeve 85 continues to underlie the sliding dog 79, which, through setting nut 75, locks the lower cone 51 in setting position. In this manner, the integrity of the anchoring means is assured, despite pressure above or below the packer, or expansion or contraction of the tubing string.

Referring to FIG. *2a*, it will be appreciated that once pins 20 have been sheared, axial travel of the top connection 15 and associated central mandrel 35 can occur within the outer assembly 32. The length of the central mandrel 35 can be selected to allow the mandrel to be free-floating, allowing the mandrel to be axially stroked a distance limited only by the difference in length between the outer packer assembly and the mandrel itself. During such movement, the integrity of the seal between the outer packer assembly and casing is maintained. This freedom of movement permits the well string to expand or contract in response to temperature extremes, without unsetting the packer, and without disturbing the integrity of the seal member.

It should also be noted that even after shearing pins 20, 42, additional torque can be applied through abutment means 19, 40 any time the central mandrel 35 is in its lowermost position and right hand torque is applied to the running string. This may be necessary if an annulus pressure test indicates the packer is not completely sealing after the initial setting step.

The cooperative effect of the shear pins 20, 42 and abutment means 19, 40 provides a positive indication at the well surface of the amount of torque applied to set the packer. Assume, for example, that the running string has been rotated in an attempt to set the packer. If the running string can then be raised at a predetermined weight, i.e., its own weight, then this indicates that the proper setting torque, i.e., 2100 ft.lbs., has actually been applied to the packer to shear pins 20, 42. Otherwise, the weight indication at the surface would be the weight of the running string, plus an additional 5000 to 11,000 lbs. for the packer and liner. This additional weight range of 5000 to 11,000 lbs. can be used as an effective surface indication that proper torque has not been applied to completely set the packer and seal off the annulus. The operator can then set down weight on top of the packer to assure engagement of the shoulders 22, 38 of top connection 15 with abutment means 19,40 and apply right hand torque to further turn setting nut 75 to more tightly pack off the well annulus.

FIG. *4a* illustrates the initial step involved in releasing the packer from the well bore. To release the packer, the central mandrel 35 is first lifted axially a sufficient distance to allow the release sub 99 to pass within the collet body 95, whereby shoulder 101 can contact the lower exposed end 93 of the support sleeve 85. Continued upward movement of the mandrel 35 causes the shear pin 91 to sever, allowing the region of decreased diameter 89 of support sleeve 85 to underlie the sliding dog. Continued movement of the mandrel causes the dog 79 to move radially inward out of the window 83 of connecting tube 37, thereby disengaging the dog 79 from setting nut 75.

Upward movement of the mandrel 35, support sleeve 85 and connecting tube 37 relaxes the primary seal 21. Continued upward movement of the mandrel 35, support sleeve 85, and connecting tube 37 causes an external shoulder of the seal mandrel end 46 (FIG. *4b*) to contact the internal shoulder 105 of the retaining ring 29. As the connecting tube 37 and seal mandrel 21 are moved upwardly, upper cone 39 is pulled upwardly, causing cone surface 39 to be pulled from beneath cam surface 41 of the slip member 43, as shown in FIG. *4b*.

Continued upward movement of the running string results in shoulder 107 of upper cone 59 contacting cage 59, as well as ledge 109 of cage 59 contacting the slip member 43 to free the slip member from gripping engagement with the well casing 13. This combination of steps normally results in freeing the anchoring mechanism of the well packer, allowing the packer to be retrieved to the well surface on the running string.

As shown in FIG. *4b*, the gripping surface 56 at the lower end of slip member 43 can continue to engage the casing 13 during the retrieval steps previously described. If difficulty is encountered in retrieving the well packer in this manner, a backup release mechanism is provided. FIG. 5 illustrates the additional release step. To facilitate release of the lower cone 51, release sub 99 is moved axially, by setting down weight on the running string, to cause end 111 to strike the lip 113 of the collet end 97. The downward force thus applied to the collet is transmitted through the upper end 69, and through the threaded engagement with the lower cone end 67, to pull the frustoconical surface 49 of the lower cone 51 from beneath the cooperating surface 47 of slip 43. The downward movement of lower cone 51 from beneath the slip member 43 completely frees the slip member for radial inward movement during the subsequent retrieval of the well packer. In cases where a back-up release mechanism is not desired, the knock-down collet can be omitted and the packer can be provided with a retainer nut (not shown) which threadably engages the end of lower cone 67 which omits the collet body 95.

An invention has been provided with several advantages. The well packer of the invention can be set in sealing engagement in a well conduit in a high temperature well environment. The packer can be set by immediately rotating the running string upon reaching the desired depth in the well. The anchoring and sealing means of the packer are moved to the set position by a threaded setting nut, which provides a dependable setting mechanism and positively locks the packer outer assembly in the set position. The packer can be released for retrieval by either rotating in the opposite direction from the setting direction, or by a straight upward pull on the running string. An improved release sub-knock-down collet assembly assures the removal of the lower spreader cone from beneath the slip means to facilitate retrieval of the tool from the well bore. By providing a well packer design with fewer parts and simpler operation, manufacturing costs are reduced, and reliability is enhanced.

While the invention has been shown in only one of its forms, it is not thus limited, but is susceptible to various changes and modifications without departing from the spirit thereof.

I claim:

1. A well packer adapted to be releasably set internally in a well bore, comprising:

a central mandrel both slidably and rotatably received within an outer assembly, said outer assembly including a top body with an interior bore of a greater diameter than and circumscribing said central mandrel, said central mandrel having an external flange region about a portion of the circumference thereof for contacting abutment means within said top body bore when said mandrel is rotated within said body to transmit torque to said outer assembly;

seal means, as a part of said outer assembly, movable radially outwardly between a retracted configuration and an extended configuration in which said seal means sealingly engage said well bore;

anchoring means, including an upper cone with a slip engaging end, an oppositely arranged lower cone with a slip engaging end, and slip means intermediate said cones within said outer assembly, said slip means having lower tapered surfaces for contacting said slip engaging ends for moving said slip means between a retracted position and an extended gripping position in which said slip means grippingly engage said well bore;

a connecting tube depending from said top body and surrounding a portion of said central mandrel, said upper cone, lower cone and slip means being slidably received about said connecting tube;

a sliding dog carried in a window provided in said connecting tube, said sliding dog being engageable with a setting nut surrounding said central mandrel, said setting nut threadedly engaging a threaded interior surface of said lower cone whereby rotation of said central mandrel transmits torque through said top body, connecting tube, sliding dog and setting nut to propel said lower cone axially for moving said seal means to said extended configuration and for moving said slip means into said extended gripping position; and a support sleeve carried about said central mandrel and connected by frangible means to a lower end of said connecting tube, said support sleeve having a region of increased diameter underlying said sliding dog and a region of decreased diameter, whereby axial movement of said support sleeve releases said dog from engagement with said setting nut to retract said seal means and slip means to release said packer.

2. A well packer adapted to be releasably set internally in a well bore, comprising:

a central mandrel both slidably and rotatably received within an outer assembly, said outer assembly including a top body with an interior bore of a greater diameter than and circumscribing said central mandrel, said central mandrel having an external flange region about a portion of the circumference thereof for contacting abutment means within said top body bore when said mandrel is rotated within said body to transmit torque to said outer assembly;

seal means, carried below said top body on said outer assembly, movable radially outwardly between a retracted configuration and an extended configuration in which said seal means sealingly engage said well bore;

anchoring means, including an upper cone with a slip engaging end, an oppositely arranged lower cone with a slip engaging end, and slip means intermediate said cones within said outer assembly, said slip means having lower tapered surfaces for contacting said slip engaging ends for moving said slip means between a retracted position and an extended gripping position in which said slip means grippingly engage said well bore; and a connecting tube depending from said top body and surrounding a portion of said central mandrel, said upper cone, lower cone and slip means being slidably received about said connecting tube;

a sliding dog carried in a window provided in said connecting tube, said sliding dog being engageable with a setting nut surrounding said central mandrel, said setting nut threadedly engaging a threaded interior surface of lower cone whereby rotation of said central mandrel transmits torque through said top body, connecting tube, sliding dog and setting nut to propel said lower cone axially for moving said seal means to said extended configuration and for moving said slip means into said extended gripping position;

a support sleeve carried about said central mandrel and connected by frangible means to a lower end of said connecting tube, said support sleeve having a region of increased diameter underlying said sliding dog and a region of decreased diameter, whereby axial movement of said support sleeve releases said dog from engagement with said setting nut to retract said seal means and slip means to release said packer; and said central mandrel having a release sub at the lower end thereof, said sub being arranged to contact a lower end of said support sleeve upon upward sliding movement of said central mandrel with respect to said outer assembly to thereby shear said frangible means and move said region of decreased diameter beneath said sliding dog, to release said dog from said lower cone.

3. A well packer adapted to be releasably set internally in a well bore, comprising:

a central mandrel both slidably and rotatably received within an outer assembly, said outer assembly including a top body with an interior bore of a greater diameter than and circumscribing said central mandrel, said central mandrel having an external flange region about a portion of the circumference thereof for contacting abutment means within said top bodys bore when said mandrel is rotated within said body to transmit torque to said outer assembly;

seal means, carried below said top body on said outer assembly, movable radially outwardly between a retracted configuration and an extended configuration in which said seal means sealingly engage said well bore;

anchoring means, including an upper cone with a slip engaging end, an oppositely arranged lower cone with a slip engaging end, and slip means intermediate said cones within said outer assembly, said slip means having lowered tapered surfaces for contacting said slip engaging ends for moving said slip means between a retracted position and an extended gripping position in which said slip means grippingly engage said well bore;

a connecting tube depending from said top body and surrounding a portion of said central mandrel, said upper cone, lower cone and slip means being slidably received about said connecting tube;

a sliding dog carried in a window provided in said connecting tube, said sliding dog being engageable with a setting nut surrounding said central mandrel, said setting nut threadedly engaging a threaded interior surface of said lower cone whereby rotation of said central mandrel transmits torque through said top body, connecting tube, sliding dog and setting nut to propel said lower cone axially for moving said seal means to said extended configuration and for moving said slip means into said extended gripping position;

a support sleeve carried about said central mandrel and connected by a frangible means to a lower end of said connecting tube, said support sleeve having a region of increased diameter underlying said sliding dog and a region of decreased diameter, whereby axial movement of said support sleeve releases said dog from engagement with said setting nut to retract said seal means and slip means to release said packer;

said central mandrel having a release sub at the lower end thereof, said sub being arranged to contact a lower end of said support sleeve upon upward sliding movement of said central mandrel with respect to said outer assembly to thereby shear said frangible means and move said region of decreased diameter beneath said sliding dog, to release said dog from said lower cone; and a knock-down collet carried about said central mandrel and connected to said lower cone, said collet having a split end for allowing upward sliding movement of said mandrel release sub through said collet and having internal shoulders for engaging said release sub upon opposite relative movement to propel said lower cone axially in a direction away from said slip means to further retract said slip means.

* * * * *